United States Patent [19]

Hintsch

[11] 4,333,501

[45] Jun. 8, 1982

[54] WEAVING MACHINE HAVING A RIGID FRAME

[75] Inventor: Otto Hintsch, Wallisellen, Switzerland

[73] Assignee: Sulzer Brothers Limited, Winterthur, Switzerland

[21] Appl. No.: 131,114

[22] Filed: Mar. 17, 1980

[30] Foreign Application Priority Data

Mar. 28, 1979 [CH] Switzerland ..... 2871/79

[51] Int. Cl.[3] ..... D03D 49/02

[52] U.S. Cl. ..... 139/1 R

[58] Field of Search ..... 139/1 R, 82, 97, 100, 139/101, 114, 57

[56] References Cited

U.S. PATENT DOCUMENTS

| | | | |
|---|---|---|---|
| 889,971 | 6/1908 | Salisbury | 139/57 |
| 2,510,404 | 6/1950 | Lake et al. | 139/82 |
| 2,737,981 | 3/1956 | Pfarrwaller | 139/1 R |
| 3,168,116 | 2/1965 | Krenz | 139/57 |
| 3,593,752 | 7/1971 | Moessinger | 139/82 |
| 3,858,619 | 1/1975 | Berry | 139/1 R |

*Primary Examiner*—Henry Jaudon

*Attorney, Agent, or Firm*—Kenyon & Kenyon

[57] ABSTRACT

The weaving machine has a frame which includes a transversely extending main girder and a spaced apart and parallel supplementary girder at the warp end. The two girders are connected together by one or more connecting members so as to form a rigid connection between the girders. The supplementary girder is of U-shape cross-section and permits a mounted warp beam to project into the opening between the flanges of the girder. The connecting members each support a guide for the guiding of drive members for the shed-forming shafts of the weaving machine.

9 Claims, 4 Drawing Figures

14
6
-50-
15
16
18
19
13
13a
21
17
21
-52-
7
4
24
4a
4b
24
38
40
38
25
34
35
37
34a
25a
38
29
54
28
26
31
29a

WEAVING MACHINE HAVING A RIGID FRAME

This invention relates to a weaving machine. More particularly, this invention relates to a weaving machine having a rigid frame.

As is known, weaving machines have been constructed with frames which contain a main girder and a supplementary girder which extends in parallel to the main girder. In weaving machines of this kind, for example as described in U.S. Pat. No. 2,798,513, the main and supplementary girders are secured only at the ends to the cheeks of the machine frame. Generally, a special box-shaped part is disposed between the two girders to contain guides for guiding drive members which serve to move shafts, for example wires, to form a shed within the weaving machine. In such a construction, particularly in weaving machines of great width, the supplementary girder may begin to vibrate during operation. These vibrations are particularly caused by the load of a warp beam mounted on the end of the machine frame. These vibrations occur particularly when a heavy multi-part warp beam is used and the load of the warp beam must be supported through an intermediate bearing mounted on the supplementary girder. Such vibrations increase the noise level of the machine and may damage the machine.

Accordingly, it is an object of the invention to provide a weaving machine wherein vibration of a supplementary girder is avoided.

It is another object of the invention to reduce the flexing of a supplementary girder of a weaving machine.

It is another object of the invention to reduce the vibrations within a weaving machine of relatively wide width.

Briefly, the invention is directed to a weaving machine which has a machine frame including a warp beam end, a cloth beam end, a main girder extending across the frame between the two ends, a supplementary girder parallel to and spaced from the main girder at the warp beam end and a plurality of drive members located between the girders for vertically driving a plurality of shed-forming shafts. In accordance with the invention, at least one connecting member is secured to and between the girders to form a rigid connection between the girders. In addition, a guide is mounted on each connecting member for guiding the drive members therein.

The term "rigid connection" is to be understood as meaning that the connecting member is secured to the girders in a fixed manner, for example by bolting at least two points to both the main girder and the supplementary girder or welded over a certain length relative to the connecting member.

The rigid connection of the supplementary girder to the main girder precludes vibration of the supplementary girder during operation of the weaving machine. Further, flexing of the supplementary girder toward the main girder, i.e. toward the cloth beam end, under the load of an especially heavy warp beam of large diameter, e.g. 1,000 millimeters and more, can be precluded.

In order to fulfill the function of the connecting member, use can be made in an appropriate manner of a structural part needed for the support of the drive member guide. In this regard, in one embodiment, the connecting member may be of multi-piece construction and include a vertically disposed plate and a pair of horizontally disposed connecting pieces fixed to the plate. Each horizontal connecting piece has an opening at each end for passage of a bolt therethrough in order to secure the connecting member to the main girder. In addition, the connecting member has a second plate secured to the connecting pieces in parallel with the first plate. The guide is, in turn, secured to and between the two plates and is of comb-like construction in order to guide the drive members therein.

In another embodiment, the connecting member may be constructed so as to be welded to the main girder and supplementary girder.

These and other objects and advantages of the invention will become more apparent from the following detailed description and appended claims taken in conjunction with the accompanying drawings in which:

FIG. 1 schematically illustrates a plan view of a weaving machine constructed in accordance with the invention;

Figure 1:
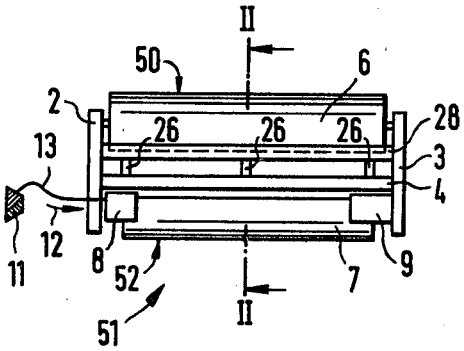

Referring to FIG. 1, the weaving machine 51 has a machine frame which includes a warp beam end 50, a cloth beam end 52, a pair of cheeks 2, 3 which extend along the side of the frame, a main girder 4 which extends across the frame between the two ends and a supplementary girder 28 which extends in parallel spaced relation to the main girder 4 at the warp beam end. The two girders 4, 28 connect with the cheeks 2, 3. The weaving machine also has a warp beam 6 at the warp beam end for delivering warp threads, a cloth beam 7 at the cloth beam end for taking up cloth, a picking mechanism 8 and a catching mechanism 9 as are known. In addition, a weft thread supply bobbin 11 is located outside of the machine frame for supplying weft thread 13 in the direction indicated by the arrow 12 to a shed 15 (see FIG. 2) which is formed in the weaving machine.

Figure 2:
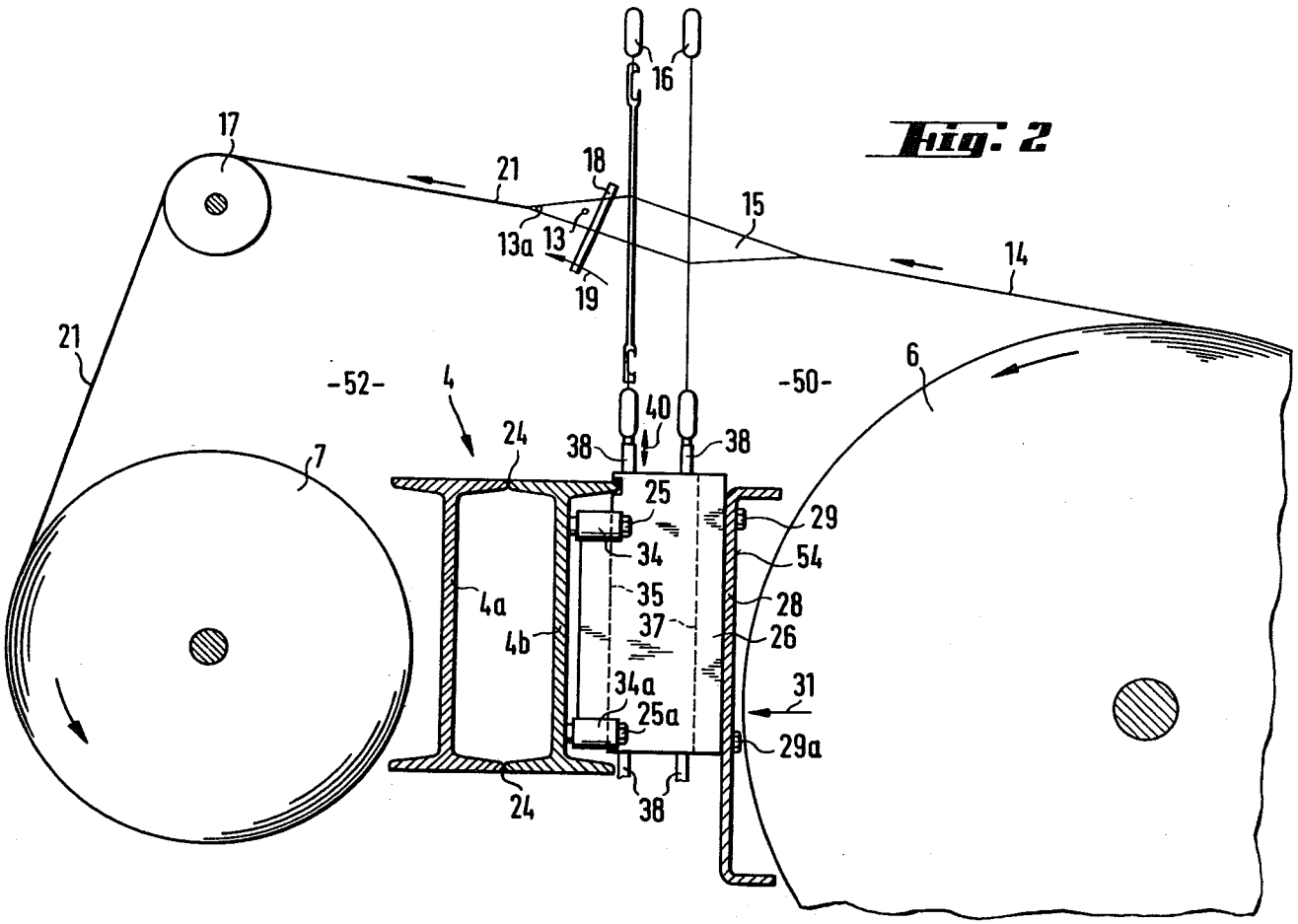
FIG. 2 illustrates a view taken on line II—II of FIG. 1.

As shown in FIG. 2, the weaving machine also includes a plurality of shed-forming shafts 16 which are driven in a vertical reciprocating manner as indicated by the arrow 40 by suitable drive members 38. As indicated, the drive members 38 are located between the girders 4, 28 and are driven from a suitable shaft or shafts (not shown). In addition, the weaving machine has a reed 18 which is reciprocated in the direction indicated by the arrow 19 so as to beat up the weft thread to the fell 13*a* so as to form cloth 21 which can be subsequently wound up on the cloth beam 7. To this end, a cloth draw-off roller 17 is disposed in the path of the cloth 21 in known manner.

Referring to FIG. 2, the main girder 4 extends transversely of the weaving machine frame, i.e. in parallel to the direction of insertion of the weft thread 13 in the shed 15. The girder 4 is formed of two I-beams 4*a*, 4*b* which are welded together along contacting flanges as indicated at 24. The supplementary girder 28 is U-shaped in cross-section and has a pair of flanges directed towards the warp end 50 of the machine frame. As indicated, the open side 54 of the supplementary girder 28 is exposed to the warp beam 6 such that the warp beam 6 projects into and between the flanges of the girder 28.

As shown in FIG. 1, a plurality, e.g. three, of connecting members are secured to and between the girders 5, 28 to form a rigid connection between the girders 5, 28. As shown in FIG. 2, each connecting member 26 is of multi-piece structure. That is, each connecting member 26 includes a vertically disposed plate and a pair of horizontally disposed connecting pieces 34, 34*a* which are fixed to the plate in any suitable manner, for example by welding. Each connecting piece, 34, 34*a* has an opening at each end for passage of a bolt 25, 25*a* therethrough into threaded engagement with the beam 4*b* of the main girder 5. In similar manner, the plate of the connecting member 26 is bolted to the supplementary girder 28 via bolts 29, 29*a* which extend through the web of the supplementary girder 28 into the plate.

The bolting of the connecting member 26 at at least two points of the main girder and at two points of the supplementary girder provides a rigid connection of the supplementary girder to the main girder. As indicated, the points of connection are vertically aligned on each girder 5, 28. This rigid connection precludes the supplementary girder 28 from flexing in a transverse manner as indicated by the arrow 31 towards the cloth end 52, for example under the loading of the warp beam 6.

Figure 3:
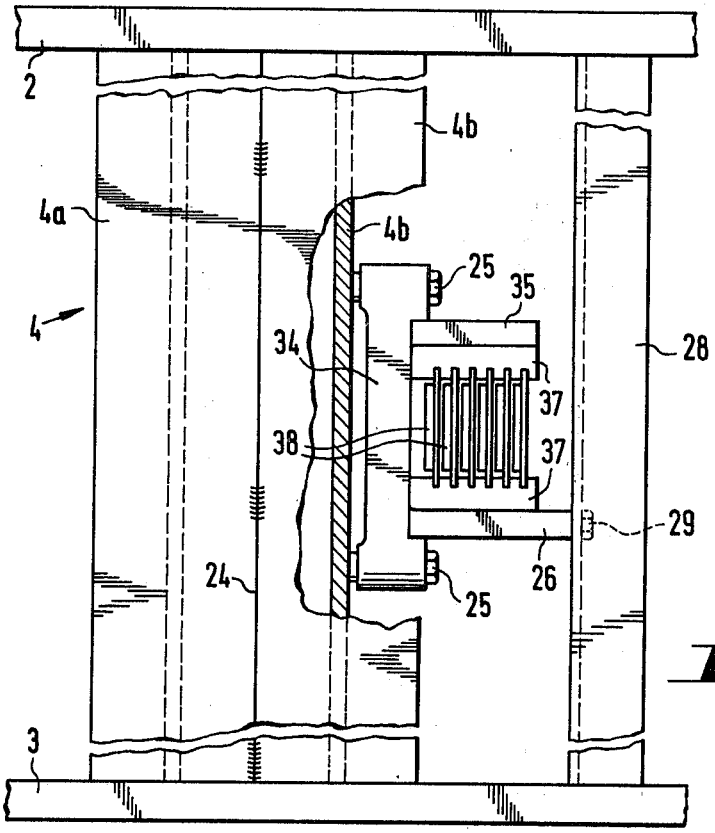
FIG. 3 illustrates a fragmentary plan view of the girders of the weaving machine of FIG. 1.

As shown in FIG. 3, each connecting member 26 includes a second plate 35 which is parallel to the first plate of the connecting member 26 and which is secured to the connecting pieces 34, 34*a* e.g. by welding. In addition, a comb-type guide 37, for example of plastic, is secured to and between the plates of the connecting member 26 e.g. by welding. This guide 37 serves to guide the drive members 38 for the shafts 16. As indicated in FIG. 3, each connecting member 26 provides a four-point fixation of the supplementary girder 28 on the main girder 4. At the same time, each connecting member 26 serves as a support for a guide 37.

It is to be noted that the number of connecting members 26 depends on the form of the shafts (not shown) for driving the drive members 38 or the drive to the shafts. If the shafts are very long, for example three meters or more, there will be, as a rule, three drive points and, hence, three connecting members 26 with guides 37 as shown in FIG. 1. In other cases, for example for weaving machines of less width and shorter shafts, two connecting members 26 with respective guides 37 may be sufficient. Further, a single connecting member 26 may also be used. Further, the connecting members 26 may be formed of screw mounted or welded multi-piece construction or of cast single-piece construction.

Figure 4:
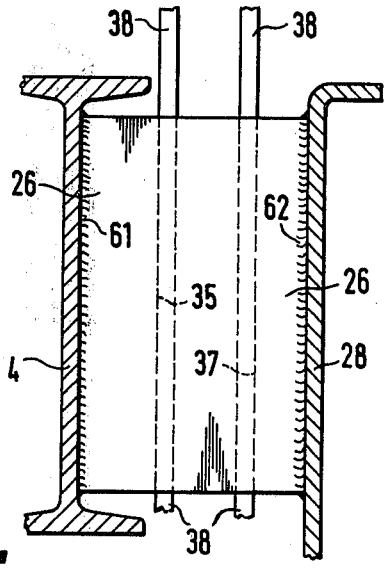
FIG. 4 illustrates a modified connecting member in accordance with the invention.

Referring to FIG. 4, wherein like reference characters indicate like parts as above, each connecting member 26 may be welded to the webs of the girders 4, 28 via linear weld connections 61, 62 respectively. In this case, the connecting piece 26 may be formed simply of a vertical plate. In addition, a second vertically disposed plate 35 is disposed in spaced paralled relation, secured e.g. by welding, so as to provide for the mounting of a guide 37 thereon secured in similar manner to the above.

The invention thus provides a connecting member which not only serves as a rigid connection between the supplementary girder and main girder of the weaving machine frame but also serves as a mounting for the guide of the guiding of the drive members for the shed-forming shafts.

What is claimed is:

1. In a weaving machine having a machine frame including a warp beam end, a cloth beam end, a main girder extending across said frame between said ends, a supplementary girder parallel to and spaced from said main girder at said warp beam end, said supplementary girder being U-shaped in cross-section with a pair of flanges directed towards said warp end of said machine frame and a plurality of drive members located between said girders for vertically driving a plurality of shed-forming shafts;

at least one connecting member secured to and between said girders to form a rigid connection between said girders, a guide mounted on said connecting member for guiding said drive members therein, and a warp beam mounted at said warp beam end of said frame and projecting into and between said flanges of said supplementary girder.

2. A weaving machine as set forth in claim 1 wherein said connecting member extends transversely of said girders and is secured at two vertically aligned points to each of said girders.

3. A weaving machine as set forth in claim 1 wherein said supplementary girder is U-shaped in cross-section with a pair of flanges directed towards said warp end of said machine frame.

4. A weaving machine as set forth in claim 1 wherein said connecting member is welded to each of said girders.

5. A weaving machine as set forth in claim 1 which includes three of said connecting members secured between said girders in transversely spaced relation and a respective guide mounted on each connecting member.

6. In a weaving machine having a machine frame including a warp beam end, a cloth beam end, a main girder extending across said frame between said ends, a supplementary girder parallel to and spaced from said main girder at said warp beam end and a plurality of drive members located between said girders for vertically driving a plurality of shed-forming shafts;

at least one connecting member secured to and between said girders to form a rigid connection between said girders, said connecting member including a vertically disposed plate and a pair of horizontally disposed connecting pieces fixed to said plate, each said connecting piece having an opening at each end for passage of a bolt therethrough; and a guide mounted on said connecting member for guiding said drive members therein.

7. A weaving machine as set forth in claim 4 wherein said connecting member includes a second plate parallel to said vertically disposed plate and secured to said connecting pieces and wherein said guide is of comb-like construction and is secured to and between said plates.

8. In a weaving machine having a machine frame including a warp beam end, a cloth beam end, a main girder extending across said frame between said ends, a supplementary girder parallel to and spaced from said main girder at said warp beam end and a plurality of drive members located between said girders for vertically driving a plurality of shed-forming shafts;

a plurality of connecting members each secured to and between said girders to form a rigid connection between said girders, each said connecting member including a vertically disposed plate secured to each of said girders substantially over the height of at least one of said girders to provide a rigid connection of said supplementary girder to said main girder to preclude flexing of said supplementary girder; and a guide mounted on said connecting member for guiding said drive members therein.

9. In a weaving machine having a machine frame including a warp beam end, a cloth beam end, a pair of I-beams welded together to define a main girder extending across said frame between said ends, a supplementary U-shaped girder extending across said frame parallel to and spaced from said main girder at said warp beam end and a plurality of drive members located between said girders for vertically driving a plurality of shed-forming shafts;

a plurality of connecting members secured to and between said girders to form a rigid connection between said girders to preclude vibration and flexing of said supplementary girder; and a guide mounted on said connecting member for guiding said drive members therein.

* * * * *

UNITED STATES PATENT AND TRADEMARK OFFICE

CERTIFICATE OF CORRECTION

PATENT NO. : 4,333,501

DATED : June 8, 1982

INVENTOR(S) : OTTO HINTSCH

It is certified that error appears in the above—identified patent and that said Letters Patent is hereby corrected as shown below:

Column 4, line 23, change "1" to --8--

Line 27, change "1" to --8--

Line 30, change "1" to --8--

Line 51, change "4" to --6--

Signed and Sealed this

*Thirty-first* Day of *August 1982*

[SEAL]

*Attest:*

GERALD J. MOSSINGHOFF

*Attesting Officer*

*Commissioner of Patents and Trademarks*